US006148831A

United States Patent [19]

Lindstrom et al.

[11] Patent Number: 6,148,831

[45] Date of Patent: Nov. 21, 2000

[54] METHOD FOR CLEANING A WEB

[75] Inventors: Jan Lindstrom, Naantali; Juha Leimu, Turku, both of Finland

[73] Assignee: Valmet Corporation, Finland

[21] Appl. No.: 09/132,784

[22] Filed: Aug. 12, 1998

Related U.S. Application Data

[63] Continuation-in-part of application No. 08/758,489, Nov. 29, 1996, Pat. No. 5,800,679.

[30] Foreign Application Priority Data

Oct. 25, 1996 [FI] Finland ..... 964297

[51] Int. Cl.[7] ..... B08B 1/02; B08B 5/04; B08B 7/04; B08B 5/00

[52] U.S. Cl. ..... 134/21; 134/15; 134/34; 134/36; 134/37; 15/309.1; 15/345

[58] Field of Search ..... 134/15, 21, 34, 134/37, 36; 15/345, 309.1; 162/272, 199

[56] References Cited

U.S. PATENT DOCUMENTS

| | | | |
|---|---|---|---|
| 2,022,593 | 11/1935 | Fuykers | 15/345 X |
| 2,082,411 | 6/1937 | Merrill | 15/14 |
| 2,956,301 | 10/1960 | Bruno | 15/306 |
| 3,078,496 | 2/1963 | Doran et al. | 15/346 |
| 3,239,863 | 3/1966 | Gardner | 15/15 |
| 3,365,359 | 1/1968 | Proulx | 162/374 |
| 3,688,527 | 9/1972 | Blustain | 68/3 SS |
| 3,775,806 | 12/1973 | Olbrant et al. | 15/306 A |
| 3,963,515 | 6/1976 | Haldeman et al. | 134/21 |
| 4,003,226 | 1/1977 | Holdsworth | 69/1 |
| 4,454,621 | 6/1984 | Testone | 15/1.5 R |
| 4,594,748 | 6/1986 | Warfvinge | 15/308 |
| 4,715,078 | 12/1987 | Howard et al. | 15/4 |
| 4,835,808 | 6/1989 | Hahne et al. | 15/1.5 R |
| 4,906,333 | 3/1990 | Myren | 162/111 |
| 5,304,254 | 4/1994 | Chino et al. | 134/37 |
| 5,313,685 | 5/1994 | Kramer et al. | 15/309.1 |
| 5,381,580 | 1/1995 | Kotitschke et al. | 15/302 |
| 5,457,847 | 10/1995 | Uzawa et al. | 15/345 |
| 5,466,298 | 11/1995 | Pollock | 134/15 |
| 5,490,300 | 2/1996 | Horn | 15/1.51 |
| 5,577,294 | 11/1996 | Pollock | 15/345 |
| 5,800,679 | 9/1998 | Lindstrom et al. | 162/272 |
| 5,916,373 | 6/1999 | Schneider | 134/15 |

FOREIGN PATENT DOCUMENTS

| | | |
|---|---|---|
| 0084633 | 8/1983 | European Pat. Off. . |
| 245526 | 11/1987 | European Pat. Off. . |
| 279109 | 8/1988 | European Pat. Off. . |
| 0480631 | 4/1992 | European Pat. Off. . |
| 0640411 | 3/1995 | European Pat. Off. . |
| 0682992 | 5/1995 | European Pat. Off. . |
| 50264 | 8/1970 | Finland . |
| 884476 | 4/1989 | Finland . |
| 78944 | 6/1989 | Finland . |
| 95611 | 1/1995 | Finland . |
| 942269 | 11/1995 | Finland . |
| 2306752 | 5/1976 | France . |
| 2006716 | 9/1970 | Germany . |
| 1786277 | 1/1972 | Germany . |
| 2602236 | 7/1977 | Germany . |
| 4215602 | 11/1992 | Germany . |
| 4305907 | 8/1994 | Germany . |
| 458680 | 6/1968 | Switzerland . |
| WO 96/07490 | 3/1996 | WIPO . |
| WO 98/19009 | 5/1998 | WIPO . |

*Primary Examiner*—Alexander Markoff
*Attorney, Agent, or Firm*—Steinberg & Raskin, P.C.

[57] ABSTRACT

A method for cleaning a web by removing dust and other particles therefrom in which a blowing is directed at a web to cause the separation of dust from the web and a suction effect is applied to the web to remove the dust separated from the web. A vortex flow may be produced before the dust separating blowing in the running direction of the web to prevent carriage of the dust into the environment and to compensate for the suction effect on the runnability of the web.

15 Claims, 3 Drawing Sheets

METHOD FOR CLEANING A WEB

This application is a continuation-in-part of U.S. patent application Ser. No. 08/758,489 filed Nov. 29, 1996, now U.S. Pat. No. 5,800,679.

FIELD OF THE INVENTION

The present invention relates to a method for cleaning a web, such as a textile web and a paper or board web, in which a blowing is directed at the web to separate dust and other contaminants from the web, and a suction effect is applied to the web for removing the dust and contaminants that are separated out of connection with the web.

BACKGROUND OF THE INVENTION

In material web forming and handling devices such as paper machines, a boundary layer of air is formed at both sides of the paper web, which usually moves at quite a high speed, as well as at both sides of a textile web or drying wire which is used to carry the paper web. Each boundary layer of air carries along with it dust that has been separated from the fibre mesh of the web and from the fillers in the web. The dust spreads into the environment surrounding the textile machine, paper machine or other device and is partly also carried to the web reel. Moreover, after the manufacture of the paper, dust and contaminants, such as debris and fibers, adhere to the face of the web.

In a paper machine, one important and significant source of dust is the slitting process, in which an abundance of dust is separated from the web when the web is slit into component webs or reels in the longitudinal direction. Problems related to the production and presence of dust also occur in the manufacture of tissue paper, in particular in connection with creping by means of a doctor, wherein the paper web is separated by means of a doctor blade from a face of a steam-heated yankee cylinder, in which connection a particularly large quantity of dust is detached from the web, which dust is drawn along by the paper web and spreads into the surrounding environment. Dust and contaminants cause problems in the further processing of the paper, for example in printing operations, because it is of vital importance from the point of view of the quality of printing that the printing rolls remain clean. Also, dust spreads both in the paper mill and in further processing of the web into the environment, and dust may result in risks for occupational health because it may contain various particles of fillers.

With respect to the prior art, reference is made to the U.S. Pat. No. 3,239,863, which describes a web cleaning device including a chamber space in which two air nozzles have been formed directed at the web. The space between the nozzles is closed so that it forms an exhaust chamber for the air coming out of the nozzles and for the dust separated from the web. In this prior art arrangement, one of the more noticeable problems is how to produce a sufficiently high air blow rate to separate the dust adhering to the web as well as the requirement to construct the device so that it is placed quite far at a distance from the web, in which case it is mainly suitable for general removal of dust, but not for detaching dust or contaminants from the web.

One prior art construction for the problems described above is described in the current assignee's Finnish Patent No. 95,611 (Finnish Patent Application No. 942269) which describes dust removing method and apparatus in which it has been considered novel that the web is subjected to a high-pressure blowing so as to separate the dust from the web and in the running direction of the web, before and after the high-pressure blowing, dust and other particles that has been separated from the web are absorbed.

OBJECTS AND SUMMARY OF THE INVENTION

Accordingly, it is an object of the present invention to provide new and improved methods for cleaning a paper or board web and a textile web such as an air-permeable wire.

It is another object of the present invention to further develop the construction of Finnish Patent No. 95,611 so that a more efficient and simpler solution is obtained, whose cost of manufacture is also lower and which is also suitable for cleaning a web from both sides across the entire width of the web.

It is a further object of the invention to provide a construction in which there are no problems of runnability, for example, arising from the vacuum necessary for sucking the dust, and by whose means it is possible to prevent access of dust as leakage flow back onto the web and into the environment.

It is another object of the invention to provide a new and improved method and device for removing dust and other undesirable contaminants from a material web as the web is running in a paper machine or other equivalent material web forming or handling device.

In view of achieving the objects stated above and others, in the method in accordance with the invention, a vortex flow is produced before a dust separating blowing is directed at the web in the running direction thereof so as to prevent carriage of the dust into the environment and to compensate for the suction effect. The vortex flow may be produced by coordinating the joint effect of the blowing direction of the dust separating blowing, the shape of a face of a dust removing device facing the web, and an air flow traveling along with the web. If an additional blowing is directed in association with a face of a dust removing device facing the web, the vortex flow may be generated by coordinating the joint effect of the blowing direction of the dust separating blowing, the shape of the face of the dust removing device facing the web, an air flow traveling along with the web and the blowing direction of the additional blowing.

For the purposes herein, the term "web" encompasses a paper or board web formed in a paper or board machine, as well as a textile web, such as an air-permeable drying wire which is used in a paper or board machine to carry the paper or board web.

In another embodiment of the method for cleaning a web in accordance with the invention, a first dust separating blowing is directed at a first side of the web to separate dust and other undesirable particles therefrom, suction is applied to the first side of the web to remove the dust and particles separated from the web proximate to and before the first dust separating blowing, and a vortex flow is generated on the first side of the web at a location before the first dust separating blowing is directed at the first side of the web in a running direction of the web. In this manner, the carrying of the dust and particles along with the web into a surrounding environment is reduced and the effect of the suction on the runnability of the web is compensated for. The vortex flow may be generated by coordinating the joint effect of the blowing direction of the first dust separating blowing, the shape of a face of a frame of a dust removing device facing the web, and an air flow traveling along with the web. An additional blowing may be directed along a face of the frame of the dust removing device facing the web, in which case, the joint effect of the blowing direction of the first dust separating blowing, the shape of the face of the frame facing the web, an air flow traveling along with the web and the blowing direction of the additional blowing are coordinated to generate the vortex flow.

In some embodiments, a second dust separating blowing is directed at a second side of the web opposite the first side of the web to separate dust and other particles from the web, suction is applied to the second side of the web to remove the dust separated from the web, and a vortex flow is generated on the second side of the web at a location after the second dust separating blowing is directed at the second side of the web in a running direction of the web. In one particularly advantageous embodiment, the first dust separating blowing is directed at the first side of the web at a location in opposed relationship to a location at which suction is applied to the second side of the web and the second dust separating blowing is directed at the second side of the web at a location in opposed relationship to a location at which suction is applied to the first side of the web. The dust separation blowings may be heated to thereby heat and dry the web.

In yet another embodiment of the method, the generation of a vortex flow is not required. Rather, a dust separating blowing is directed at each side of the web and suction is applied at a location in opposed relationship to each location at which a dust separating blowing is directed at the web. In other words, a first dust separating blowing is directed at the first side of the web and suction is applied to the second side of the web at a location in opposed relationship to the location at which the first dust separating blowing is directed at the web. Also, a second dust separating blowing is directed at the second side of the web and suction is applied to the first side of the web at a location in opposed relationship to a location at which the second dust separating blowing is directed at the web. Such an embodiment is most effective for an air-permeable textile web such as a drying wire. Also, it is advantageous if the force of the first and second dust separating blowings are regulated such that dust is separated from both the first and second sides of the web by the effect of each of the first and second dust separating blowings. Nevertheless, a vortex flow may be generated on the first side of the web at a location before the first dust separating blowing is directed at the first side of the web and after the suction is applied to the first side of the web.

The device in accordance with the invention comprises an arrangement for producing a vortex flow before a blow device for generating a dust separation blowing in the running direction of the web so as to prevent carriage of the dust into the environment, i.e., along with the web through the terminal end of the device, and to compensate for the suction effect, i.e., the detrimental effect of the suction on the runnability of the web.

In the arrangement in accordance with the invention, the face of the blow device that is placed facing the web is shaped so that part of the cleaning jet is turned back towards the nozzle slot, in which case, by means of the vortex formed, it is possible to control the vacuum in the space and thereby to avoid problems of runnability caused by an excessively high vacuum. Also in the arrangement in accordance with the invention, the suction chamber is shaped and dimensioned so that the high-speed cleaning jet has enough time and space to be turned into the exhaust air duct, whereby access of dust as a leakage flow back onto the web and into the environment are precluded. The arrangement in accordance with the invention is suitable for cleaning the web from both sides and moreover, if necessary, in particular when a web wider than normal is being run through the machine. With a view toward cleaning the web edges by means of the dust removing device, the ends of the device can be provided with side blow nozzles. In the arrangement in accordance with the invention, the exhaust air duct is preferably shaped so that an intensive vortex is formed in the duct, whereby the duct remains clean and moreover, the bottom of the pressure chamber is shaped so that, with an adequate flushing velocity, adhering of dust to the faces in the device is substantially prevented.

In the arrangement in accordance with the invention, the blow nozzle slot is designed so that the slot is adjustable, in which case the intensity of the dust separation blowing can be regulated readily.

The dust removing device in accordance with the invention can also be arranged to be inclinable in the running direction of the web in compliance with the angle of arrival of the web into connection with the blow device and with the paper grade (grade of the web) that is run, so as to obtain an optimal cleaning result.

The device in accordance with the invention extends preferably across the entire width of the machine and, if necessary, for example when placed at spreader rolls after a slitter, it can be bent to the desired form, for example to the form of deflected rolls, and the bending can be controlled, for example, by means of measurement of distance from the web face.

In the following, the invention will be described in more detail with reference to the figures in the accompanying drawing. The invention is, however, by no means strictly confined to the details of the illustrated embodiments.

BRIEF DESCRIPTION OF THE DRAWINGS

The following drawings are illustrative of embodiments of the invention and are not meant to limit the scope of the invention as encompassed by the claims.

DETAILED DESCRIPTION OF THE PREFERRED EMBODIMENTS

Figure 1:
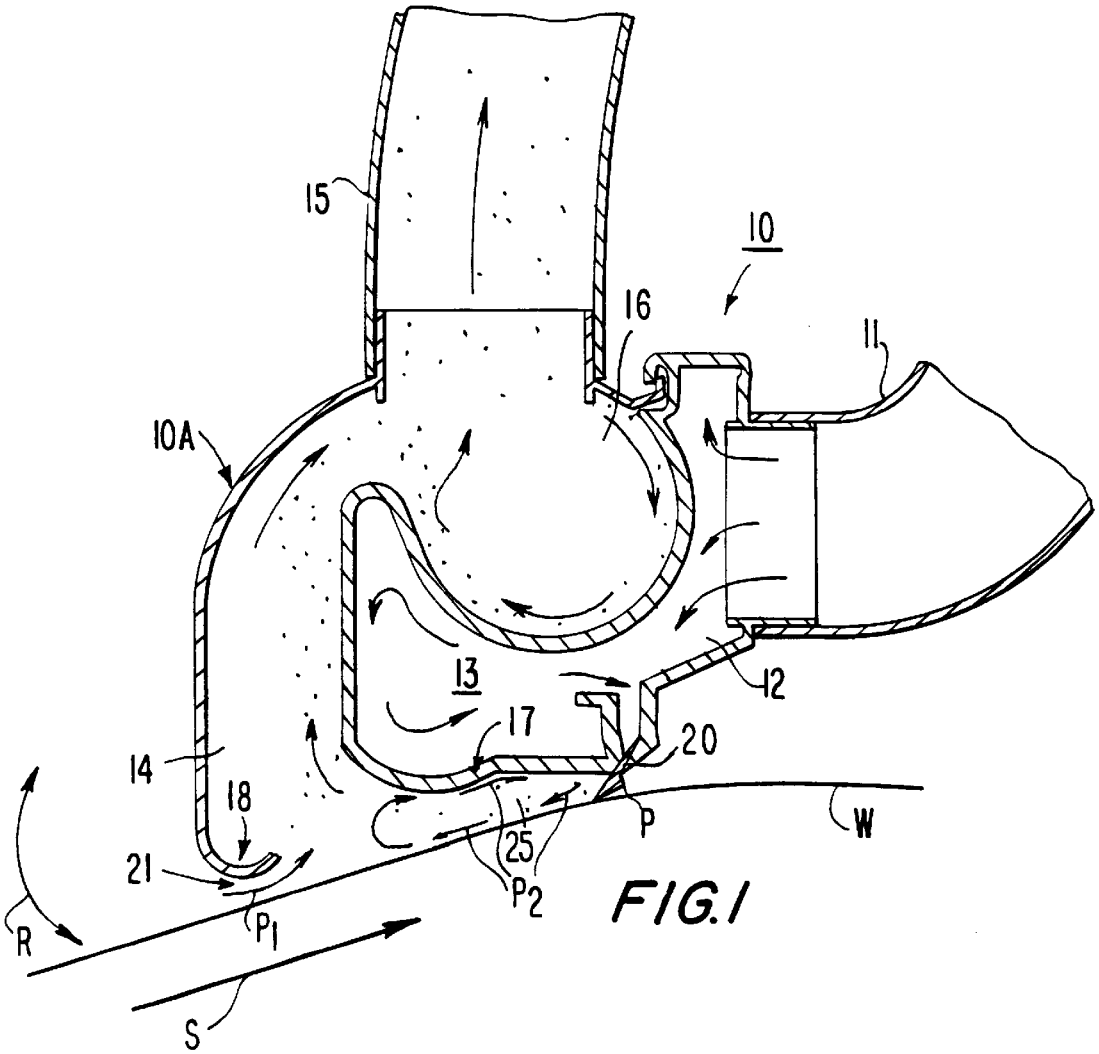
FIG. 1 is a schematic vertical sectional view in the machine direction of a device in accordance with the invention and which can be used in a method in accordance with the invention.

Referring to the accompanying drawings wherein the same reference numerals refer to the same or similar elements, in the exemplifying embodiment shown in FIG. 1, air or another equivalent flow medium is passed into a dust removing device designated generally at 10 along an intake air duct 11. From the intake air duct 11, the air is passed into a blow-air chamber 13 defined in a frame 10A, and from the air-blow chamber 13, the air is passed through a nozzle opening 20 as a high-pressure air jet P directed toward a web W running past the device 10. Reference character "W" thus designates any web, paper, board or textile, which needs to be cleaned (which cleaning encompasses the removal of dust and other particles). The running direction of the web W is denoted by reference arrow S, and the air flow traveling along with the web is denoted by reference arrow $P_1$. The frame 10A of the dust removing device 10 also includes an exhaust air chamber denoted by reference numeral 14, and a vortex chamber 16 is shaped within the exhaust air chamber 14 and produces an intensive vortex therein to keep the exhaust air chamber 14 clean. From the exhaust air chamber 14, the air is passed into an exhaust air duct 15 fluidly coupled thereto.

With respect to the positioning of the duct removing device 10, the dust removing device 10 is placed near the web W so that a space 25 is formed between the surface of the dust removing device 10 facing the web W and the web W. In this space 25, a vortex air flow $P_2$ is formed by the joint effect of the dust separation blowing P at a bottom face 17 of the device and the air flow $P_1$ carried along with the web W, and by means of the vortex $P_2$, the access of dust as a leakage flow back along with the web W, and thus into the surrounding environment, is prevented. The vortex $P_2$ is formed by means of the dust separation blowing P, by means of the air flow $P_1$ traveling along with the web W, by means of the shape of the face 17 of the suction chamber 14 of the dust removing device 10 placed facing the web W, and by means of the dimensioning of the vortex space 25, for example, by regulating the distance of the device 10 from the web W. The generation of the vortex $P_2$ is dispensable in certain embodiments, such as when a dust separating blowing and suction are provided on an opposite side of the web as discussed below.

Dust is separated from the web when a sharp air jet, a dust separation blow P, is blown out of the nozzle opening 20, which jet penetrates through the boundary layer and separates the particles of dust from the web face. The separated dust is removed into the suction chamber 14 by a suction effect generated proximate to and before the nozzle opening 20, and the air that contains dust particles is then passed to a cleaning stage, for example, in a wet separator.

The blow pressure of the dust separation blowing may be regulated to be from about 2 kPa to about 50 kPa, preferably from about 15 kPa to about 35 kPa, for example, when the dust removing device in accordance with the invention is used for removing dust from printing papers/boards. The blow velocity to be used in the dust separation blowing P may be regulated or controlled to be from about 50 meters per second to about 400 meters per second, preferably from about 50 meters per second to about 300 meters per second. Of course, the values to be used for the blow pressure and velocity may be outside of these ranges and depend on the strength of the web that is being run, i.e., on the intensity of blowing that the web can endure and on the intensity of blowing that is necessary to separate the dust from the web face. It has been recognized that when softer paper grades are being run, lower values are used. The vacuum in the suction chamber 14 should be from about 0.5 kPa to about 6 kPa, preferably from about 1 kPa to about 3 kPa, but, of course, the values of vacuum to be used in the suction chamber also depend on the paper grade that is being run and may be outside of these ranges in certain situations. The distance of the blow device from the web face should be from about 1 mm to about 40 mm, preferably from about 2 mm to about 10 mm.

In certain embodiments, the nozzle opening 20 is adjustable so that the intensity and the direction of 11 the dust separation blowing P can be regulated by adjusting the nozzle opening 20. If necessary, the dust removing device 10 can also be inclined by appropriate pivot means, the movement being represented schematically by the arrow R, in compliance with or as a function of the angle of arrival of the web W, and if it is paper or board web, with the grade of the web W that is being run, so that an optimal cleaning result is obtained.

Figure 2:
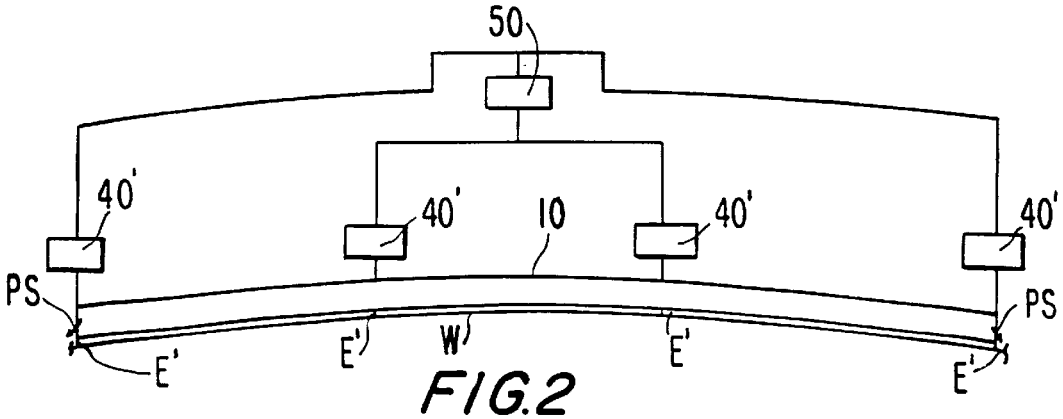
FIG. 2 is a schematic illustration of a device in accordance with the invention in the direction of width of the web and which can be used in a method in accordance with the invention.

As shown in FIG. 2, the dust removing device 10 extends substantially across the entire width of the web W, and, if necessary, it can be bent to the desired deflected shape, for example, of the spreader rolls after a slitter, i.e., in correspondence with the curvature of the web. The bending can be controlled, for example, by means of measurements of distance E' from the web W face and the positioning of regulation members 40 which are controlled based on the measurement results and based on control signals from a control unit 50 so that the dust removing device 10 is bent to the desired shape. For cleaning of the edges of the web W, it is possible to provide the ends of the dust removing device 10 with side blow nozzles, out of which the blowing PS is blown. This arrangement is particularly advantageous when a web W wider than normal is run.

In the exemplifying embodiment shown in FIG. 1, the vortex $P_2$ has been produced so that the face 17 of the dust removing device 10 that is placed facing the web and that starts from the suction chamber 14 has, in the direction of arrival of the web W, first been formed as convex towards the web W, after which there follows a linear portion, which ends in the nozzle opening 20. The vortex $P_2$ can be intensified by also shaping a guide face 18 of the dust removing device 10 that defines an inlet opening 21 of the air flow $P_1$ arriving along with the web W, for example, curved, as shown in FIG. 1. The guide face 18 can also be shaped in some other way, compare, for example, FIGS. 4 and 5. In the illustrated embodiments, on the whole, the air flows passing in the dust removing device 10 are denoted by arrows.

Figure 3:
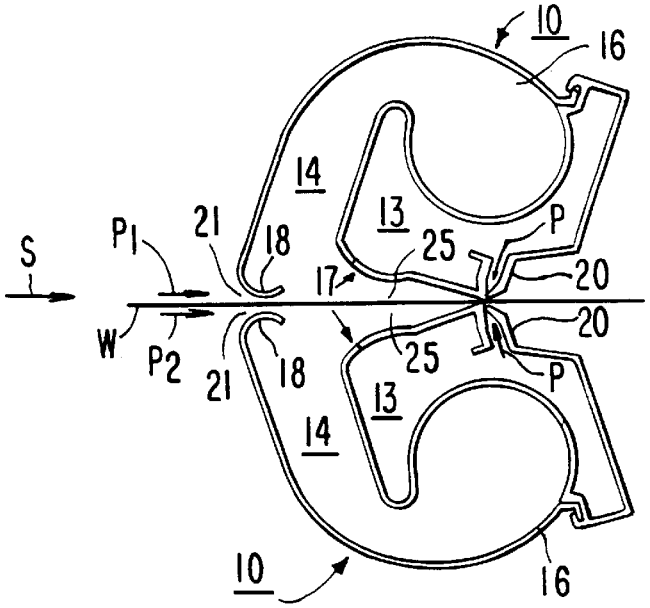
FIG. 3 is a schematic illustration of an arrangement of the device in accordance with the invention at both sides of the web and which can be used in a method in accordance with the invention.

FIG. 3 is a schematic illustration of an exemplifying embodiment in which dust removing devices 10 as described above are placed at both sides of the web W. This arrangement is constructed preferably so that the nozzle openings 20 of the dust removing devices 10 are placed facing one another, in which case the vortex spaces 25, in which the vortex flow $P_2$ is produced by the effect of the lower face 17 of the device 10, of the dust separation blowing P, and of the air flow $P_2$, are placed substantially one opposite to the other.

Figure 4:
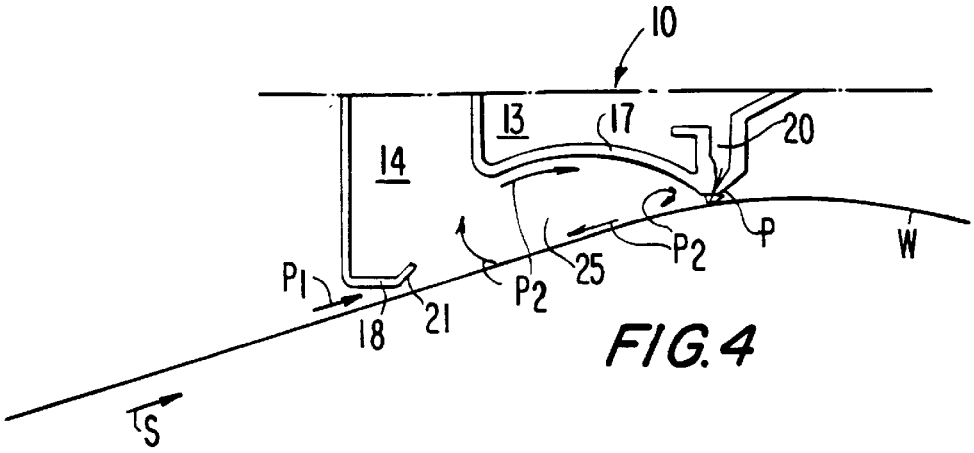
FIG. 4 is a schematic illustration of a further exemplifying embodiment of the face of the suction chamber in a device in accordance with the invention and which can be used in a method in accordance with the invention.

FIG. 4 shows an exemplifying embodiment of the shape of the lower face 17 of the air chamber 13 in the dust removing device 10 so as to produce a vortex $P_2$ in the space 25. In this exemplifying embodiment, the lower face 17 has been shaped concave in relation to the web W face from the suction chamber 14 to the nozzle opening 20. The guide face 18 that defines the inlet opening 21 for the air flow $P_1$ is bent so that it is substantially L-shaped in relation to the running direction of the web W.

Figure 5:
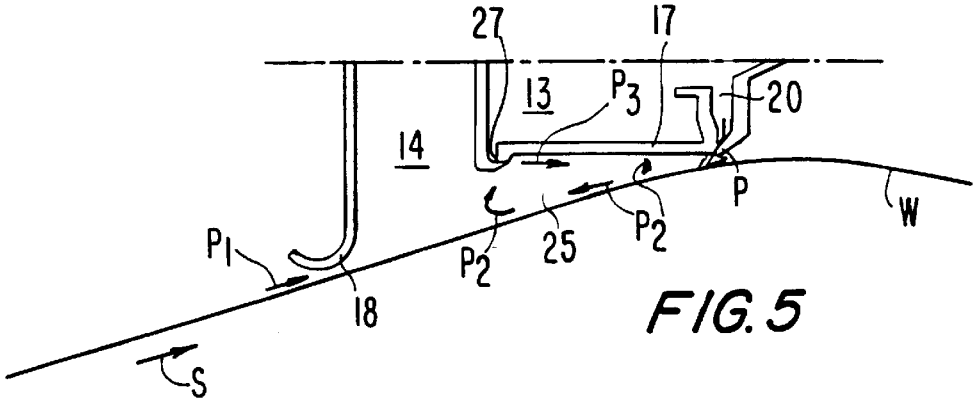
FIG. 5 shows a second further exemplifying embodiment of the face of the suction chamber in a device in accordance with the invention and which can be used in a method in accordance with the invention.

FIG. 5 shows a second exemplifying embodiment for producing a vortex air flow $P_2$ in the space 25, and in this exemplifying embodiment the vortex flow $P_2$ is produced, besides by means of the dust separation blowing P, the air flow $P_1$ traveling along with the web W, and the shape of the lower face 17, also by means of a blowing $P_3$ through a nozzle opening 27 formed in the lower face 17. Blowing $P_3$ is directed in a direction parallel to the lower face 17 and generally in the running direction S of the web and thus has a directional component substantially contrary to the direction of the dust separation blowing P. In this exemplifying embodiment, the lower face 17 is substantially linear, and the guide face 18 is curved but bent towards the direction of arrival S of the web W.

The scope of the invention, of course, also includes embodiments in which the embodiments are connected with guide faces 18 and/or lower faces 17 of different types and shapes.

Figure 6:
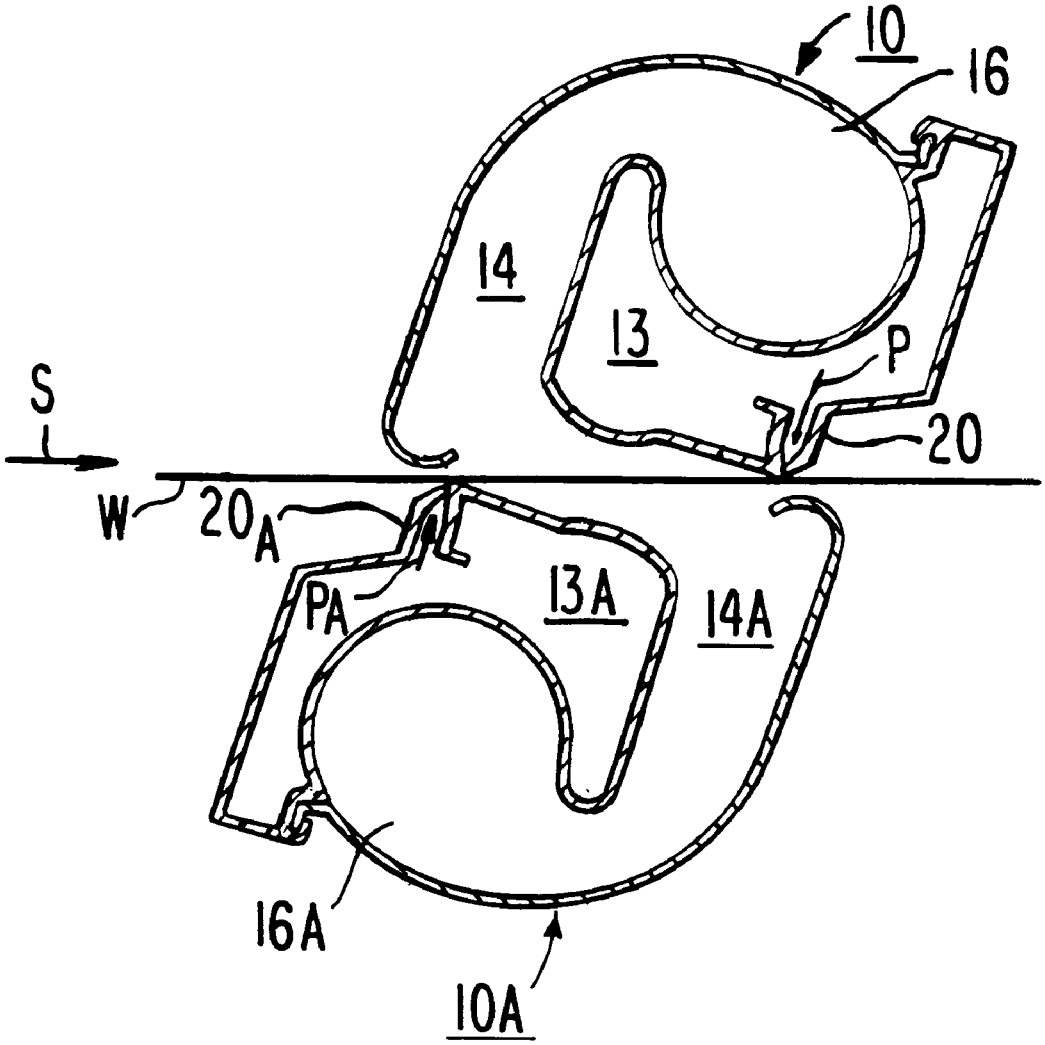
FIG. 6 is a schematic illustration of another arrangement of the device in accordance with the invention at both sides of the web and which can be used in a method in accordance with the invention.

FIG. 6 is a schematic illustration of an exemplifying embodiment in which dust removing devices 10 as described above are placed at both sides of the web W. Differing from the embodiment in FIG. 3, the lower dust removing device, designated 10A, has been turned 180° about a vertical axis so that the suction chamber 14 above the web W is situated in opposed relationship to a location at which the dust separating blowing PA is operative against the web. Similarly, the suction chamber 14 below the web W is situated in opposed relationship to a location at which the dust separating blowing P is operative against the web. In this manner, there is a partial vacuum at one side of the web and a blowing at the same point on the opposite side of the web, i.e., a positive pressure is arranged to affect the web W at the point where suction is prevailing thereby enhancing the removal of dust and other undesirable particles from the web W. This arrangement is particularly advantageous when a textile web such as a drying wire is being cleaned, i.e., dust and other particles are being removed therefrom. The blowings P,PA clean the web W on both sides because a portion of the blowings pass through the web W while the suction prevailing at the opposed side of the web W enables the separated materials to be effectively collected. The blowings P,PA may also be heated so that the web W is heated and dried.

In this embodiment, a vortex may not be generated on either side of the web. Rather, there is sufficient dust separation and removal resulting from the two dust separating blowings P,PA and the application on suction on an opposite side of the web in opposed relationship to each dust separating blowing P,PA.

The examples provided above are not meant to be exclusive. Many other variations of the present invention would be obvious to those skilled in the art, and are contemplated to be within the scope of the appended claims. For example, a vortex flow can be produced in a number of different ways besides the exemplifying embodiments illustrated in the figures.

We claim:

1. A method for cleaning a web by a dust removing device, comprising the steps of:

directing a first dust separating blowing at a first of the web to separate dust and other particles from the web, applying suction to the first side of the web to remove the dust and particles separated from the web at a location proximate to and before the first dust separating blowing in a running direction of the web, directing a second dust separating blowing at a second side of the web opposite the first side of the web to separate dust and other particles from the web, the second dust separating blowing being directed at a location in opposed relationship to a location at which suction is applied to the first side of the web, applying suction to the second side of the web to remove the dust and other particles separated from the web, the suction being applied to the second side of the web at a location in opposed relationship to a location at which the first dust separating blowing is directed at the first side of the web, and generating a vortex flow on the first side of the web at a location before the first dust separating blowing is directed at the first side of the web such that carrying of the dust and particles along with the web into a surrounding environment is reduced and the effect of the suction on the runnability of the web is compensated for.

2. The method of claim 1, wherein the step of generating the vortex flow comprises the step of coordinating the joint effect of the blowing direction of the first dust separating blowing, the shape of a face of a dust removing device facing the web and an air flow traveling along with the web.

3. The method of claim 1, further comprising the steps of:

generating a vortex flow on the second side of the web at a location after the second dust separating blowing is directed at the second side of the web in the ruing direction of the web.

4. The method of claim 1, wherein the vortex flow is generated between the web and the dust removing device, further comprising the step of:

regulating the distance of the dust removing device from the web in a direction transverse to the running direction of the web.

5. The method of claim 1, wherein the vortex flow is generated between the web and the dust removing device, further comprising the step of:

inclining the dust removing device in the running direction of the web based on an angle of arrival of the web relative to the dust removing device.

6. The method of claim 1, wherein the vortex flow is generated between the web and the dust removing device and the web is a paper or board web having a grade, further comprising the step of:

inclining the dust removing device in the running direction of the web based on an angle of arrival of the web relative to the dust removing device and on the grade of the web.

7. The method of claim 1, further comprising the step of:

regulating the blow pressure of the first dust separating blowing to be between about 2 kPa and about 50 kPa.

8. The method of claim 1, further comprising the step of:

regulating the blow velocity of the first dust separating blowing to be between about 50 meters per second and about 400 meters per second.

9. The method of claim 1, further comprising the step of:

regulating the blow velocity and blow pressure of the first dust separating blowing as a function of the strength of the web.

10. The method of claim 1, wherein the web is a paper or board web, further comprising the step of:

regulating the suction applied to the first side of the web as a function of the grade of the web.

11. The method of claim 1, further comprising the step of:

adjusting a nozzle slot through which the first dust separating blowing is passed to thereby regulate the intensity and direction of the first dust separating blowing.

12. The method of claim 1, wherein the vortex flow is generated between the location at which suction is applied to the first side of the web and the first dust separation blowing.

13. The method of claim 1, further comprising the step of:

heating the first dust separation blowing to thereby heat and dry the web.

14. The method of claim 1, wherein the web is an air-permeable textile web.

15. The method of claim 1, wherein the web is a paper or board web.

* * * * *